United States Patent [19]

Swingley, Jr.

[11] 4,432,467

[45] Feb. 21, 1984

[54] REINFORCED LID CONSTRUCTION FOR SECURITY CONTAINERS OR THE LIKE

[75] Inventor: Harold E. Swingley, Jr., Monona, Wis.

[73] Assignee: Menasha Corporation, Neenah, Wis.

[21] Appl. No.: 355,364

[22] Filed: Mar. 8, 1982

[51] Int. Cl.[3] ..... B65D 43/14

[52] U.S. Cl. ..... 220/334; 220/337

[58] Field of Search ..... 220/334, 337, 339, 342

[56] References Cited

U.S. PATENT DOCUMENTS

| | | | |
|---|---|---|---|
| 1,847,834 | 3/1932 | Iacobitti . | |
| 1,869,742 | 8/1932 | Edmunds . | |
| 1,941,514 | 1/1934 | Sutherand . | |
| 2,321,473 | 6/1943 | Ferguson . | |
| 2,444,895 | 7/1948 | Ringler . | |
| 3,145,904 | 8/1964 | Bromley . | |
| 3,282,462 | 11/1966 | Box . | |
| 3,362,561 | 1/1968 | Bakos . | |
| 3,463,345 | 8/1969 | Bockenstette . | |
| 3,655,088 | 4/1972 | Box . | |
| 3,747,796 | 7/1973 | Kneier et al. . | |
| 4,161,261 | 7/1979 | Frater | 220/337 |
| 4,364,489 | 12/1982 | Alexeeff | 220/334 |

FOREIGN PATENT DOCUMENTS

| | | |
|---|---|---|
| 1089785 | 11/1980 | Canada . |
| 1089786 | 11/1980 | Canada . |
| 115208 | 10/1945 | Sweden . |
| 596500 | 1/1948 | United Kingdom . |

*Primary Examiner*—George E. Lowrance

*Attorney, Agent, or Firm*—Quarles & Brady

[57] ABSTRACT

An attached-lid security container with overlapping lid sections is provided at the free edges of the lid sections with box-like vertical reinforcement and abutment wall configurations that provide vertical strength for the lid sections and that are facingly engageable with one another to limit lateral movement.

6 Claims, 9 Drawing Figures

REINFORCED LID CONSTRUCTION FOR SECURITY CONTAINERS OR THE LIKE

BACKGROUND OF THE INVENTION

This invention relates particularly to attached-lid security containers of the type shown in U.S. Pat. No. 4,161,261, issued July 17, 1979, to Frater for "Security Container," but it is also applicable to other containers or items utilizing closable lid sections.

Attached-lid security containers are used, for example, in various materials handling applications. They are preferably stackable and nestable, and are now generally of molded plastic construction. The security and strength of the lid closure are important to protect the contents, prevent unauthorized entry, and prevent collapse when a number of containers are stacked or other heavy weights are applied, as when a user stands or places heavy items on the closed lid. The construction in aforesaid U.S. Pat. No. 4,161,261 provides half-length overlapping areas for improved strength and security. In addition, there are projections on the undersides of upper areas that are received through openings in facing lower areas to limit transverse spreading that could otherwise result from deflection when forces are applied to the top of the closed lid, and this further enhances the strength and security of the construction. This arrangement is quite satisfactory, but the present invention provides even greater strength and security.

Another relevant type of lid arrangement is shown in U.S. Pat. No. 3,463,345, issued Aug. 26, 1969, to Bockenstette for "Lidded Tote Box." This patent shows lid sections with a series of raised teeth that interfit with complementary teeth on the other lid section and rest on depressed areas therebetween, and the present invention is also applicable to interfitting lids of this type. In one known toothed construction, the teeth are provided with peripheral vertical reinforcing flanges, and generally transverse portions of the flanges are provided with cross notches that receive upstanding lugs in the depressed areas to limit transverse separation. This arrangement is not totally effective, however, because the notches weaken the flanges and the engagement with the lug is against the end of the relatively narrow flange, which could result in the flange being sheared or broken away.

SUMMARY OF THE INVENTION

The basic concept of this invention resides in the provision of a vertical reinforcing wall on one lid section that has a longitudinal main portion and integral transverse end portions, and a vertical abutment on the other section that is at least facingly engageable with the inner surfaces of the reinforcing wall main and end portions. Both the reinforcing wall and abutment provide increased strength for the lid sections as such, and engagements between them limit transverse separation or other lateral movement. In the preferred embodiments, the abutments are themselves full walls to provide maximized strength and engagement, there are abutment walls on both sides of the reinforcing walls, and/or there are box-like wall configurations received within one another to provide maximum strength and engagement.

The arrangement of the invention is particularly adaptable to containers such as that shown in the aforesaid U.S. Pat. No. 4,161,261, but it will be seen that it is also readily adaptable to toothed or other interfitting configurations. It could also be used in a non-symmetrical lid configuration where one lid section overlaps the other along its entire length.

The arrangement of the invention gives greatly increased strength and security and is extremely versatile, but at the same time it is relatively simple and inexpensive to manufacture and use. The foregoing and other objects and advantages will appear more completely from the description to follow.

DESCRIPTION OF THE PREFERRED EMBODIMENTS

Figure 1:
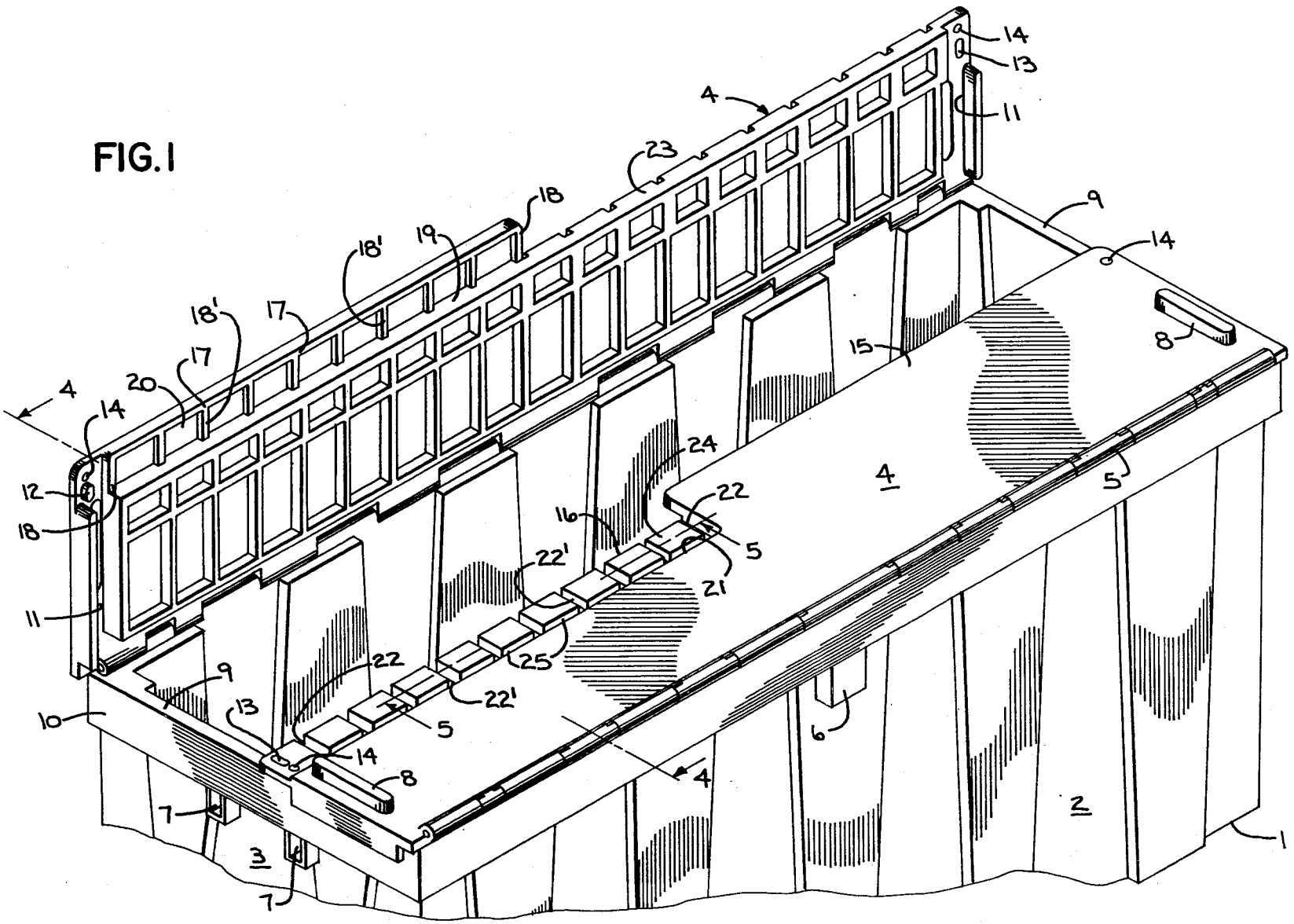
FIG. 1 is an isometric view, partially broken away, of a security container incorporating a lid construction constituting a preferred embodiment of the invention.
Figure 2:
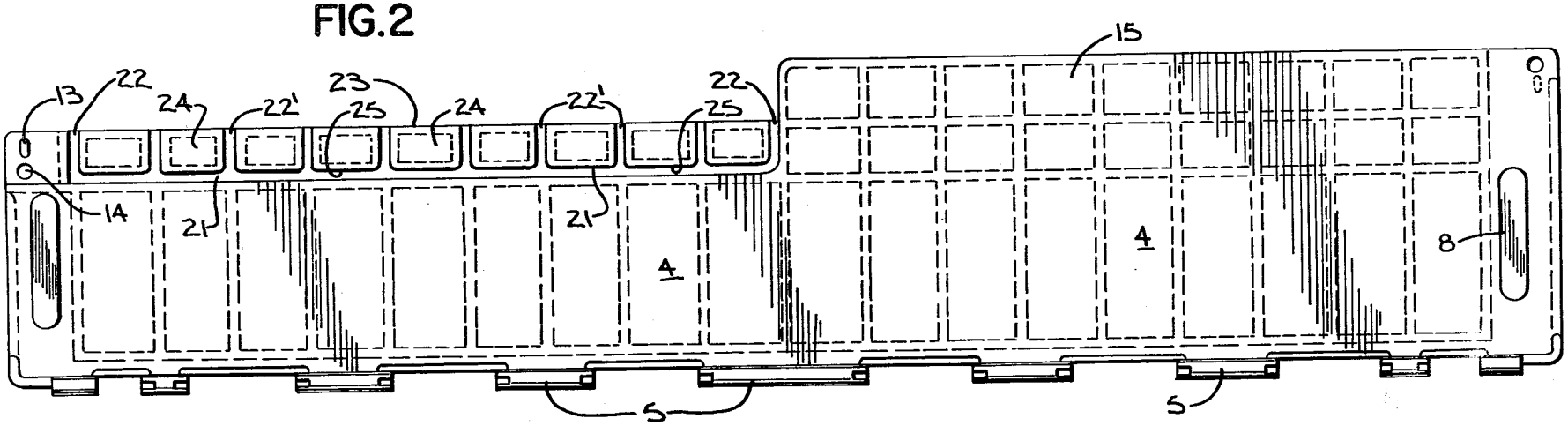
FIG. 2 is a somewhat enlarged top plan view of one of the lid sections of the container of FIG. 1.
Figure 3:
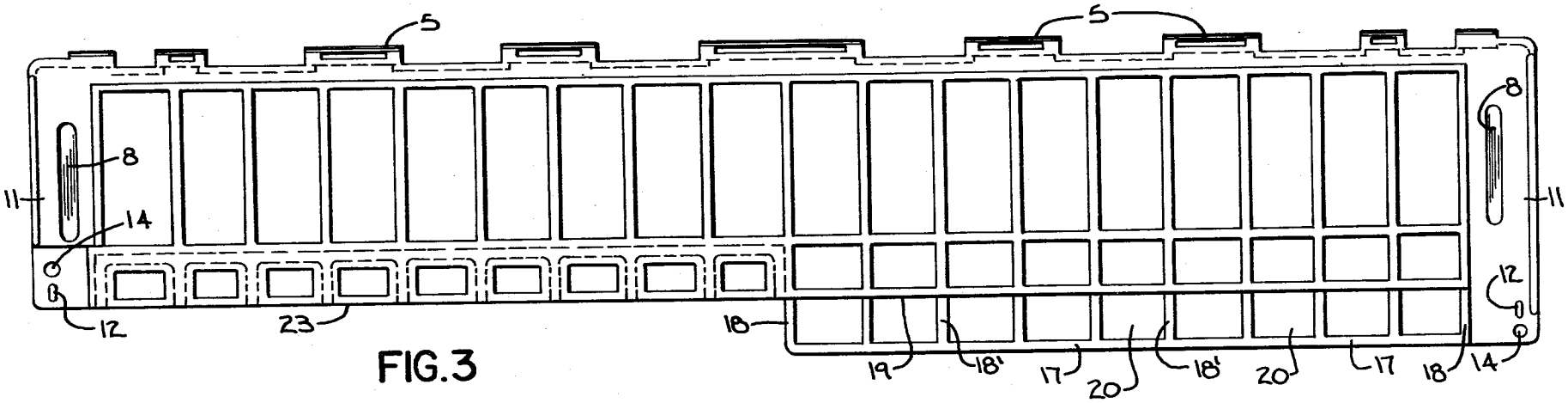
FIG. 3 is a bottom plan view of the lid section of FIG. 2.

The security container shown in FIG. 1 is of generally conventional overall configuration, and, except for the reinforcement/abutment configuration in the overlapping lid areas, is essentially the same in all material respects as that shown in the aforesaid U.S. Pat. No. 4,161,261, to which reference may be had for a further description. It is preferably of molded plastic construction.

The container proper comprises a bottom wall 1 (not actually seen), side walls 2 and end walls 3. Identical, but reversed end-for-end, lid sections 4 are hinged at 5 to the tops of the side walls 2. In the preferred embodiment shown, the lid sections 4 are separate integrally molded components, but they could be molded with the container proper using living hinges.

As is conventional, the side and end walls 2 and 3 are upwardly and outwardly tapered so that two or more containers can be nested, the lid sections 4 then hanging downwardly along the outsides of the side walls 2 but being arranged to hang closely enough to the side walls to avoid taking up unnecessary space. The side walls 2 are provided with nesting stops 6, and members 7 that define the ends of handles on the end walls 3 also serve as nesting stops. When the lid sections 4 are closed, they present an upwardly flat surface at the level of the tops of the side and end walls 2 and 3, and a like container can then be stacked thereon. End rails 8 and the upstanding hinges 5 limit horizontal movement of an upper stacked container.

The tops of the end walls 3 are provided with outwardly extending horizontal flanges 9 and downwardly extending vertical flanges 10. The ends of the lid sections 4 are appropriately shaped to define channels 11, as the result of which the ends of the lid sections 4 rest on and embrace the tops of the side walls 3 when the lid sections are closed. The forward corners at the ends of the lid sections 4 also overlap one another, and the underside of one end of each lid section 4 is provided with a projection 12 that is received through an opening 13 that extends through the other lid section 4 and the flange 9 for more secure engagement. Openings 14 extend through the ends of the lid sections 4 and the flanges 9, and are aligned when the lid sections are closed for application of a security tie or seal (not shown).

Each lid section 4 is provided along its free edge with a relatively upper area or flap 15 that extends along approximately half its length and extends forwardly beyond the line of closure. Each lid section 4 also has a relatively lower area 16 that extends along approximately the other half of the length of its free edge and that extends forwardly less than the area 15, approximately to the line of closure. When the two lid sections 4 are closed, the upper area 15 of each overlaps the lower area 16 of the other to provide mutual support and enhanced strength and security.

The free edges of the lid sections 4 are provided in their overlapping areas—the facing areas of the undersides of the areas 15 and the upper surfaces of the respective areas 16—with reinforcement means and abutment means as will be described. While the terms "reinforcement" and "abutment" have been chosen for convenience in description, it will be apparent that both provide reinforcement for the free edges of the lid sections 4 by way of vertically extending members, and that both provide abutment surfaces to limit lateral movement. The term "vertical" is used for convenience to indicate a transverse relationship to the main planes of the lid sections 4, which are usually horizontal when they are closed; and "forward" and "rear" are used for convenient reference to distances that are, respectively, farther from the hinges 5 and closer to the free edges, or closer to the hinges and farther from the free edges. "Inner" and "outer" are used with respect to full or partial box constructions as will be seen.

The reinforcement means is on the underside of each upper area 15 and is in the form of an integral, vertical wall configuration that includes a forward main portion 17 that extends along substantially the entire length of the free edge of the area 15, to be parallel to the line of closure, and that extends toward the associated area 16 when the lid sections are closed. It also includes end portions 18 and intermediate cross portions 18' that extend transversely rearwardly from the wall 17 to approximately the line of closure. A rear wall 19 is provided that extends between the rear ends of the portions 18, 18' and that is parallel to the wall 17 and spaced rearwardly of it. The walls 17, 18, 18' and 19 together define a series of longitudinally arrayed, open, full box-like wall configurations 20, with common walls, that are generally rectangular and are longitudinally arranged along substantially the entire length of the area 15; and the walls 17, 18, 18' can be said to form partial boxes not closed at their rear ends.

The abutment means comprises an integral groove configuration having a rear main portion 21 that is generally parallel to the line of closure but disposed rearwardly therefrom and that extends substantially the entire length of the area 16. There are also end portions 22 and intermediate cross portions 22' that extend forwardly from the portion 21 to the line of closure, the grooves 21 and 22, 22' mating with and receiving the walls 17 and 18, 18' when the lid sections 4 are closed. A forward vertical abutment wall 23 is provided that extends between the forward ends of the groove portions 22, 22' to be along the line of closure generally parallel to and forwardly spaced from the groove 21, and it too extends along substantially the entire length of the area 16. The walls of the grooves 21 and 22, 22' and the wall 23 are all vertical walls that extend toward the associated area 15 when the lid sections 4 are closed. They also define between them a longitudinally arrayed plurality of box-like wall configurations 24 that extend along substantially the entire length of the area 16 and that mate with and are received in the box configurations 20 when the lid sections 4 are closed; again, the grooves 21 and 22, 22' form partial boxes. In the preferred embodiment shown, these boxes 24 are closed over with material extending between the tops or free edges of the forming walls to provide additional strength, but they could be open. The forward wall 25 of the main groove 21 constitutes a main inner abutment wall portion that faces and is substantially coextensive with the main reinforcing wall 17.

Figures 4, 5, 6, 7, 8, 9:
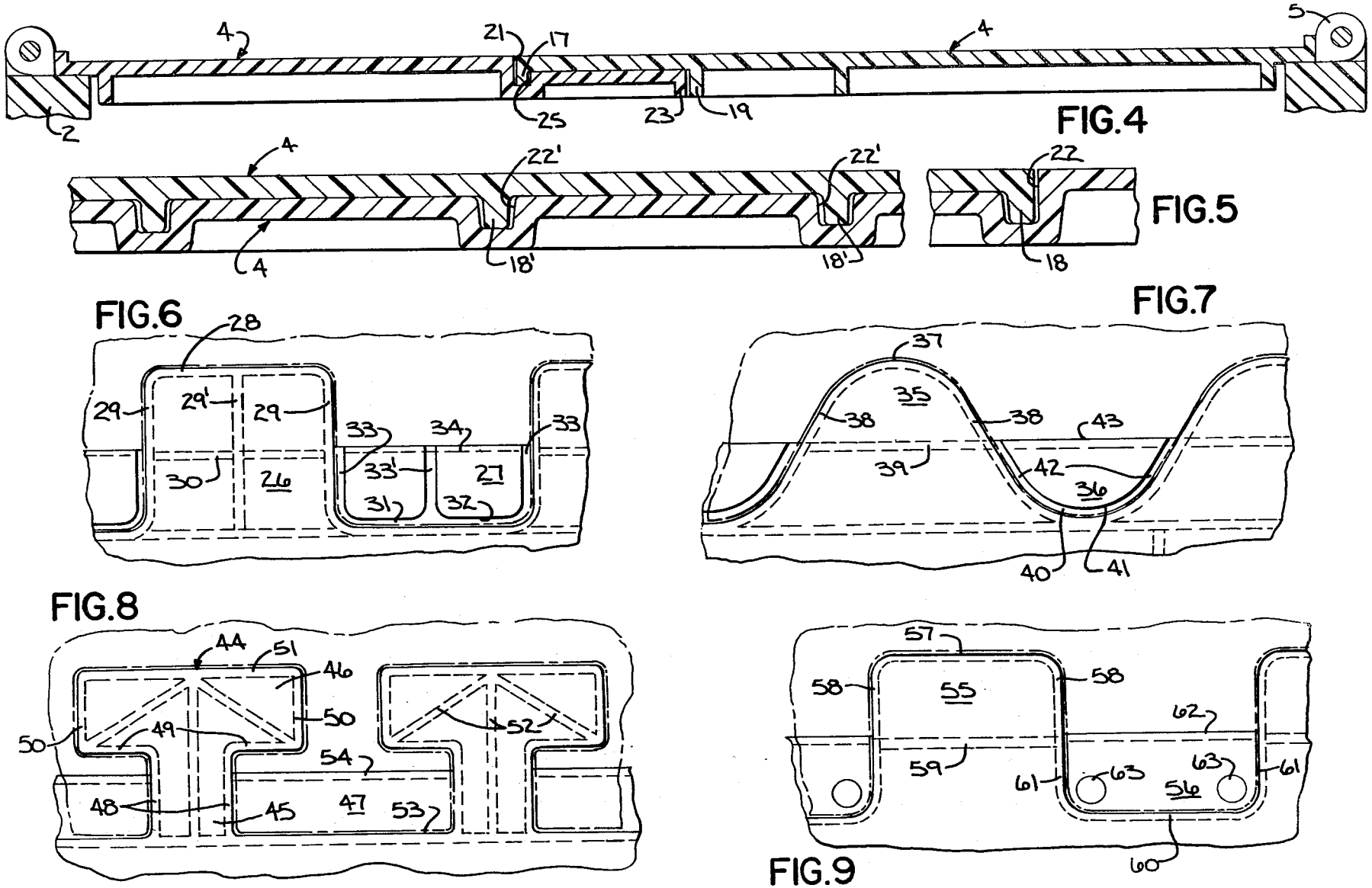
FIG. 4 is a further enlarged fragmentary view in cross section taken through the plane 4—4 shown in FIG. 1, but showing the two lid sections in closed relationship.
FIG. 5 is a further enlarged, interrupted fragmentary view in cross section similar to FIG. 4, but taken through the plane 5—5 shown in FIG. 1.
FIG. 6 is a fragmentary plan view illustrating another embodiment in which the invention is incorporated in an interfitting lid configuration, portions of an opposite lid section being shown in broken lines.
FIG. 7 is a view similar to FIG. 6, but illustrates another embodiment utilizing a sinusoidal tooth configuration.
FIG. 8 is another view similar to FIG. 6, but illustrates still another embodiment utilizing an interlocking T-shaped tooth configuration.
FIG. 9 is still another view similar to FIG. 6, but shows an embodiment utilizing abutment bosses with a toothed lid configuration.

The engagements of the described elements when the lid sections 4 are closed is best seen from FIGS. 4 and 5. In closed position, the main wall 17 is received in the main groove 21, as the result of which the main inner abutment wall or surface 25 is facingly engageable with the inner, with respect to the boxes 20, surface of the wall 17. This engagement is very important in limiting lateral separation of the lid sections 4 that could occur, for example, when the area along the line of closure is deflected downwardly as the result of a vertical force on the closed lid or should there be a force tending to spread the side walls 2. In addition to this engagement, the forward or outer surface of the wall 17 faces and is engageable with the rear wall of the groove 21, which can be said to be an outer abutment wall with respect to the box 20. This latter engagement limits the lid sections 4 in movement toward one another, and it also helps in preventing lateral separation as the result of downward deflection, in that such deflection will cause the upper edges of these facing walls to butt against one another. As can also be seen in FIG. 4, and with respect to the boxes 20, the forward wall 23 forms another inner abutment wall that is facingly engageable with the inner surface of the wall 19 when the lid sections 4 are closed, which provides further strength and security in the manner of the engagement between the outer surface of the wall 17 and the rear or outer abutment wall of the groove 21.

As can be seen in FIG. 5, the transverse walls 18, 18' are received in the transverse grooves 22, 22' when the lid sections 4 are closed, with the vertical walls of the grooves facing and being engageable with the opposite sides of the walls. This means that the boxes 24 are in effect received in the boxes 20, with the nearest walls of any two grooves 22 or 22' serving as inner abutment walls leading from the wall 25 facingly engageable with the inner surfaces of the associated walls 18 or 18' and the outer groove walls serving as outer abutment walls leading from the outer abutment wall of the groove 21 and engageable with the outer reinforcing wall surfaces. This provides longitudinal stability, but it is also helpful with respect to lateral separation in that the transverse walls and grooves provide integrated reinforcement-/abutment configurations of substantially increased overall strength and effectiveness. This is particularly true with the box-like configurations provided by the preferred embodiment shown, but the transverse walls and grooves would be very helpful in conjunction with the wall 17 and groove 21 even if the walls 19 and 23 were eliminated. Some or all of the intermediate walls 18' and grooves 22' could also be eliminated, but providing a suitable number substantially increases effectiveness by providing what amounts to a longitudinal array of reinforcement/abutment configurations with common walls and grooves between them.

The walls 17, 18, 18' and 19 provide greatly increased strength and rigidity for the areas 15. Likewise, the walls 23 and the vertical walls defined by the grooves 21 and 22, 22' provide greatly increased strength and rigidity for the areas 16. In addition, the noted engagements provide further strength and stability, particularly against lateral separation or other movement. The net result is a lid construction that is very strong and secure but at the same time is relatively simple and inexpensive to manufacture and use.

While the embodiment of FIGS. 1–5 is preferred, the invention is, as previously indicated, applicable to other basic lid configurations and FIGS. 6–9 show some alternative embodiments. Each of these views shows only a portion of the free edge of one lid section in full lines, with a corresponding portion of the other lid section being shown in broken lines in the position it would assume when the lid sections are closed. It will be appreciated that the configurations shown will in each case be provided along at least a substantial portion of the free edge of each lid section.

In the embodiment of FIG. 6, the free edge of each lid section is provided with a plurality of longitudinally spaced, relatively raised teeth 26 that extend forwardly beyond the line of closure. Intermediate the teeth 26 are relatively depressed shelves 27 that extend approximately to the line of closure. When the lid sections are closed, their teeth 26 interfit—lie between one another—and the forward portion of each tooth 26 overlaps an associated shelf 27. Each tooth 26 is provided with reinforcement means comprising a forward main reinforcing wall portion 28 that is toward the forward end of the tooth 26 and generally parallel to the line of closure, and that corresponds essentially to the wall 17. There are also end and intermediate, rearwardly extending transverse wall sections 29, 29' that correspond essentially to the walls 18, 18', and rear walls 30 rearwardly spaced from and generally parallel to the walls 28 that correspond essentially to the walls 19. Each shelf 27 is provided with abutment means comprising a rear main groove portion 31 that is generally parallel to and spaced rearwardly from the line of closure and the forward surface 32 of which constitutes a main abutment wall or surface, this corresponding essentially to the groove 21 and wall 25. There are also end and intermediate, forwardly extending transverse groove sections 33, 33' that correspond essentially to the grooves 22, 22', the outer walls of the end grooves 33 being essentially continuations of the outer surfaces of the end walls 29. There is also a forward wall 34 that corresponds essentially to the wall 23. The engagements between the reinforcement and abutment elements are essentially the same as those in the embodiment of FIGS. 1–5, including having the same box-like configurations, with the shelf boxes being closed over with the material of the lid.

The embodiment of FIG. 7 is much like that of FIG. 6, except that teeth 35 and shelves 36 are sinusoidal rather than squared. The reinforcement means comprises a peripheral wall the forward sections 37 of which are generally parallel to the line of closure and correspond essentially to the walls 28, and the wings 38 of which extend generally transversely rearwardly and correspond essentially to the end walls 29. There is also a rear wall 39 corresponding essentially to the wall 30. The abutment means comprises a mating sinusoidal groove having rear main portions 40 that are generally parallel to the line of closure and correspond essentially to the grooves 31, including defining a main abutment wall surface 41 corresponding to the wall 32. Wings 42 correspond essentially to the end grooves 33, and a forward wall 43 corresponds essentially to the wall 34. Again, the engagements are very similar to those in the embodiment of FIGS. 1–5, including having box-like wall configurations, closed over for the shelves. It will be noted that there are no intermediate transverse wall and groove portions, but these could be included if desired.

The embodiment of FIG. 8 is a fully interlocking toothed configuration. The free edge of each lid section is provided with a longitudinally spaced series of relatively raised, T-shaped teeth that project forwardly beyond the line of closure and include forwardly extending neck portions 45 with cross bar portions 46 at the outer ends thereof. Between the neck portions 45 of each adjacent set of teeth 44, there are relatively depressed shelves 47 that preferably stop substantially short of the line of closure to allow sufficient clearance for opening and closing. When the lid sections are closed, their teeth 44 interlock with each tooth having its neck portion 45 between the ends of two adjacent cross bar portions 46 on the opposite lid section and its cross bar portion 46 between the neck portions 45 of the same opposite teeth and resting on the intermediate shelf 47.

The teeth 44 are provided with peripheral vertical reinforcing walls comprising, beginning from the lid section proper, neck portions 48 that extend along the sides of the neck portions 45, inner cross bar portions 49 that extend along the rear, interrupted borders of the cross bars 46, cross bar end portions 50 that extend along the ends of the cross bars 46, and outer cross bar portions 51 that extend along the forward borders of the cross bars 46. Arrow-shaped interior wall configurations 52 are preferably provided for strength, but they do not play any part in the engagements described below. The neck walls 48 extend vertically upward from the ends of the shelves 47 and, with a similarly upstanding rear wall 53, define the end and rear borders of the shelves. The forward borders of the shelves 47 do not extend upwardly as seen in FIG. 8, but downwardly extending walls 54 are preferably provided for added strength.

The engagements of the embodiment of FIG. 8 are similar to the basic and most important engagements of the previous embodiments, but may be somewhat more difficult to visualize. Considering the two upright teeth 44 shown in full lines in FIG. 8, the wall portions 49, 51 can together be considered a main reinforcing wall that is generally parallel to the line of closure and corresponds essentially to the walls 17, 28 and 37. The wall portions 49 of the intermediate inverted tooth shown in broken lines can be considered as main abutment walls generally parallel to the line of closure and behind the indicated main reinforcing walls, essentially like the surfaces 25, 32 and 41. The walls 51 engageably face the walls 53 in essentially the same manner as, for example, the outer surface of the wall 17 engageably faces the outer abutment wall of the groove 21 in the embodiments of FIGS. 1–5. The wall portions 50 engageably face the wall portions 48, with essentially the same effect as, for example, the engagements of the walls 18 in the grooves 22 in the embodiment of FIGS. 1–5, except that the transverse end portions thus formed are offset as the result of the T-configuration. The important thing to remember with respect to the embodiment of FIG. 8 is that the walls 49 function as both reinforcement walls and abutment walls depending on how they are viewed. In addition, there are no box-like wall configurations received within one another as in the previous embodiments, but the configurations shown in which the necks 45 and cross bars 46 are of substantial width provides a strong and integrated structure.

The embodiment of FIG. 9 is most like that of FIG. 6. It includes relatively raised teeth 55 and relatively depressed shelves 56. The teeth 55 have main reinforcing walls 57 corresponding to the walls 28, end (but not intermediate) walls 58 that correspond to the walls 29, and rear walls 59, but the walls 59 are for strength purposes only and do not facingly engage any components on the shelves 56. The shelves 56 are basically flat like the shelves 47 in the embodiment of FIG. 8. Their rear borders are defined by walls 60 and their end borders are defined by walls 61, which are essentially extensions or continuations of the walls 58. There are downwardly extending walls 62 at the forward edges, but these are for strength only and do not engage. Instead of the grooves 31 and 33 shown in the embodiment of FIG. 6, there are vertically upstanding cylindrical abutments or bosses 63 that are at and inwardly spaced from the rear corners, i.e. forwardly spaced from the walls 60 and inwardly spaced from the walls 61. The vertical surfaces of the abutments 63 that face the walls 60 correspond to at least end parts of the inner main abutment surface 32 shown in the embodiment of FIG. 6, with the walls 60 corresponding to what would be the rear wall or outer abutment surface of the groove 31. The vertical portions of the bosses 63 that face the walls 61 correspond to at least parts of the inner abutment walls of the end grooves 33, and the walls 61 themselves correspond to the outer abutment walls of those grooves. There are no full box-like configurations, but the engagements of the embodiment of FIG. 9 are otherwise much like those of the embodiment of FIG. 6. The smaller areas of engagement provided by the abutments 63 do not provide the same full wall-to-wall engagements, but they do together provide vertical abutment surfaces that are generally parallel and transverse to the line of closure and this may be sufficient at least for certain applications.

All of the embodiments shown and described provide greatly improved strength and security. The vertical reinforcement and abutment configurations provide increased strength for the lid sections as such, and also provide facing engagements to limit lateral movement. While the embodiment of FIGS. 1–5 is preferred, the embodiments of FIGS. 6–9 illustrate that variations are possible, and other or further variations may be made without departure from the spirit of the invention. As indicated, the box-like configurations shown are particularly satisfactory, but the secondary wall configurations, e.g. walls 19, 23 in the embodiment of FIGS. 1–5, could be eliminated. The invention is also applicable to still other lid configurations. An arrangement like that shown in the embodiment of FIGS. 1–5, for example, could be used for a non-symmetrical lid arrangement in which one lid section overlaps the other along its entire length. In view of these and other possible modifications, the invention is not intended to be limited by the showing or description herein, or in any other manner, except as may specifically be required.

I claim:

1. In a security container or the like having opposite hinged lid sections that meet along a line of closure, each lid section having at its free edge a relatively lower shelf area and a relatively upper area that overlaps the shelf of the other lid section when the lid sections are closed, the undersides of the upper areas being provided with downwardly extending vertical peripheral reinforcing flanges that are generally U-shaped and include forward main portions generally parallel to the line of closure and generally transverse end portions joined to and extending rearwardly therefrom, the shelves being provided with upwardly extending vertical peripheral outer abutment walls that include rear main portions generally parallel to the line of closure and generally transversely forwardly extending end portions and that are substantially coextensive with and facingly engageable with the corresponding outer surfaces of the reinforcing flanges when the lid sections are closed, the improvement wherein:

the shelves are provided with upwardly extending vertical inner abutment wall structures that are inside the reinforcing flanges when the lid sections are closed, said inner abutment wall structures comprising rear walls that are substantially coextensive and facingly engageable in wall to wall fashion with the main portions of the reinforcing flanges when the lid sections are closed, and end walls joined to and extending forwardly from the rear walls that are substantially coextensive and facingly engageable in wall to wall fashion with the corresponding end portions of the reinforcing flanges when the lid sections are closed.

2. A container or the like according to claim 1, wherein:

the reinforcing flanges include rear portions that are joined to and extend between the rear ends of the end portions and are generally parallel to the main portions; and the inner abutment wall structures include forward walls that are joined to and extend between the forward ends of the end walls and that are substantially coextensive and facingly engageable in wall to wall fashion with the inner surfaces of the rear portions of the reinforcing flanges when the lid sections are closed.

3. A container or the like according the claim 2, wherein:

there is an integral cover portion joining the upper edges of the inner abutment wall structure components.

4. A container or the like according to claims 1, 2 or 3, wherein:

the upper area of each lid section extends along substantially one-half of the length of the free edge thereof and projects forwardly therefrom; the shelf of each lid section extends along substantially the other half of the length of the free edge thereof and projects forwardly less than the upper area; and the reinforcing flanges and inner abutment wall structures include intermediate cross portions to define for each overlapping area a longitudinal array of sets of respectively engageable reinforcing flanges and inner abutment wall structures.

5. In a security container or the like having opposite hinged lid sections that meet along a line of closure, wherein the free edge of each lid section comprises a relatively lower shelf portion that extends along approximately one-half of its length and a relatively upper overhanging portion that extends along approximately the other one-half of its length and projects forwardly farther than the shelf portion and overlaps the shelf portion of the other lid section when the lid sections are closed, the improvement wherein, the overlapping area of one portion of each lid section is provided along substantially its entire length with a longitudinal array of upstanding inner abutment wall configurations that present external forward, rear and side abutment wall surfaces; and the overlapping area of the other portion of each lid section is provided along substantially its entire length with a longitudinal array of upstanding reinforcement flange configurations that mate with and closely surround the abutment wall configurations of said one portion of the opposite lid section when the lid sections are closed and that present forward, rear and side internal wall surfaces that are then substantially coextensive and facingly engageable with the corresponding abutment wall surfaces of said opposite lid section.

6. A container or the like according to claim 5, wherein: the abutment wall configurations comprise forward, rear and side walls with an integral cover extending between and joining the top edges thereof.

* * * * *